United States Patent [19]

McDonnell

[11] 3,982,757

[45] Sept. 28, 1976

[54] TORSION TYPE ARM EXERCISING APPARATUS

[76] Inventor: Richard J. McDonnell, 1004 Hillcrest Drive, DeSoto, Tex. 75115

[22] Filed: Apr. 17, 1975

[21] Appl. No.: 569,187

[52] U.S. Cl. ..... 272/134; 272/136; 73/381; 272/140

[51] Int. Cl.[2] ..... A63B 21/00; A63B 23/00

[58] Field of Search ..... 272/67, 68, 79 R, 83 R, 272/82, DIG. 5, DIG. 4, 79 D; 73/379, 380, 381; 58/114

[56] References Cited

UNITED STATES PATENTS

| | | | |
|---|---|---|---|
| 399,942 | 3/1889 | Soeding | 73/380 X |
| 839,803 | 1/1907 | Amsler | 73/136 A |
| 2,233,764 | 3/1941 | Bauermeister | 272/83 R |
| 2,728,188 | 12/1955 | Hettich | 58/114 X |
| 2,782,033 | 2/1957 | Ugartechea | 272/67 |
| 3,467,376 | 9/1969 | Feinberg | 272/67 X |
| 3,563,542 | 2/1971 | Wellman | 73/380 R X |
| 3,747,925 | 7/1973 | Seeger | 272/83 A |
| 3,802,701 | 4/1974 | Good | 272/83 A X |
| 3,822,061 | 7/1974 | Sigma | 272/83 R |

*Primary Examiner*—Richard C. Pinkham
*Assistant Examiner*—William R. Browne
*Attorney, Agent, or Firm*—Hubbard, Thurman, Turner & Tucker

[57] ABSTRACT

An exercising apparatus useful for exercising the arms and shoulders of the user is disclosed. The arm exercising apparatus comprises a housing with a torsion member affixed to the housing whereby the torsion member will resist a rotating force that is applied thereon. An elongated lever extends from the housing and is operably connected to the torsion member. When a force is exerted in a predetermined direction on the free end of the lever, the force is thereby transmitted to the torsion member to exert a rotating force on the torsion member. The housing can have a suitable concavity formed therein to permit the elbow of the user to be seated in said concavity. The user of the device can place his elbow in the concavity and then grip the free end of the lever. Force is then applied in a predetermined direction to move the lever in said predetermined direction. Because of the operable connection between the torsion member and the lever, the free end of the lever will resist the force applied by the user thereon.

10 Claims, 6 Drawing Figures

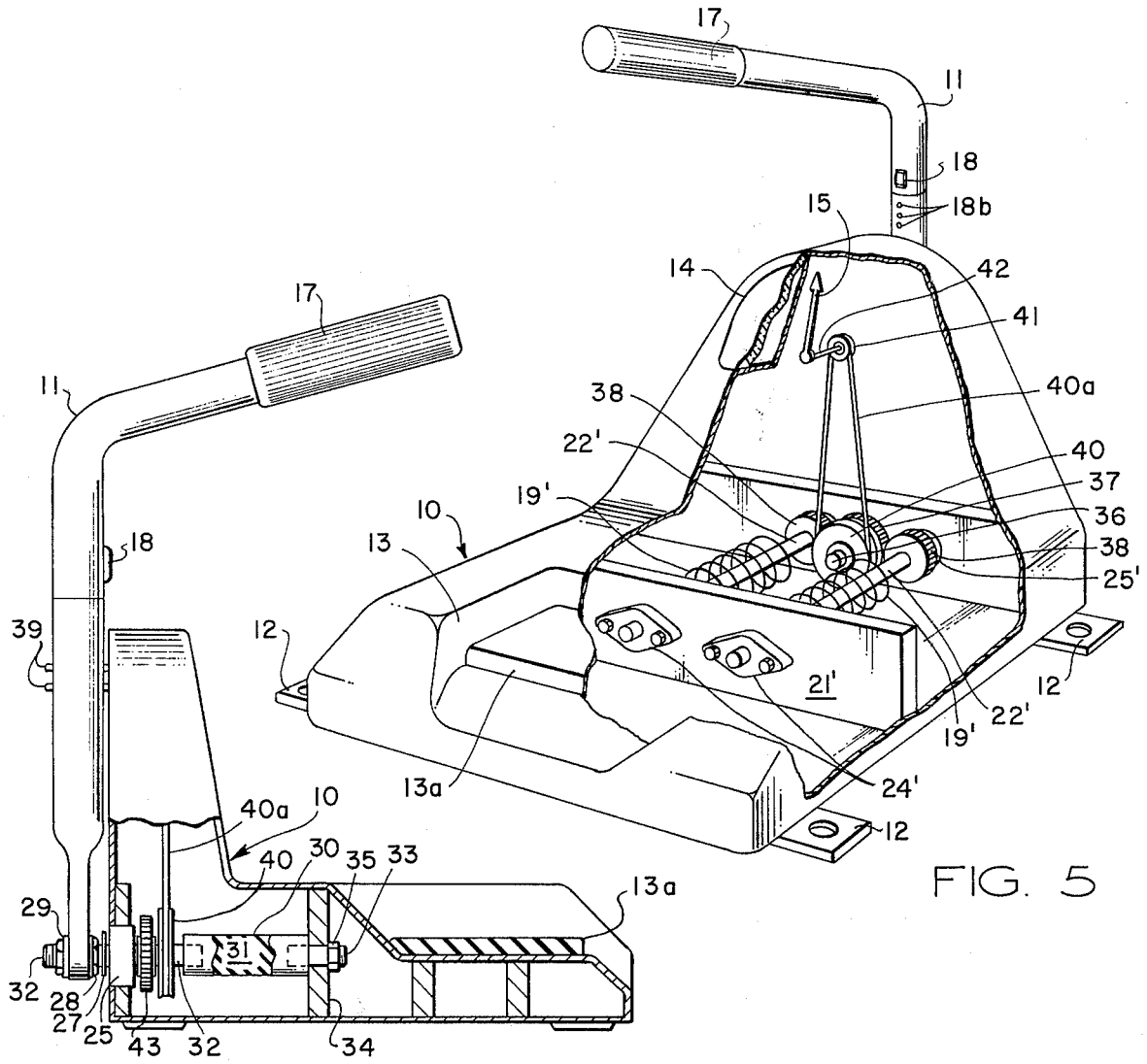
FIG. 5
FIG. 4
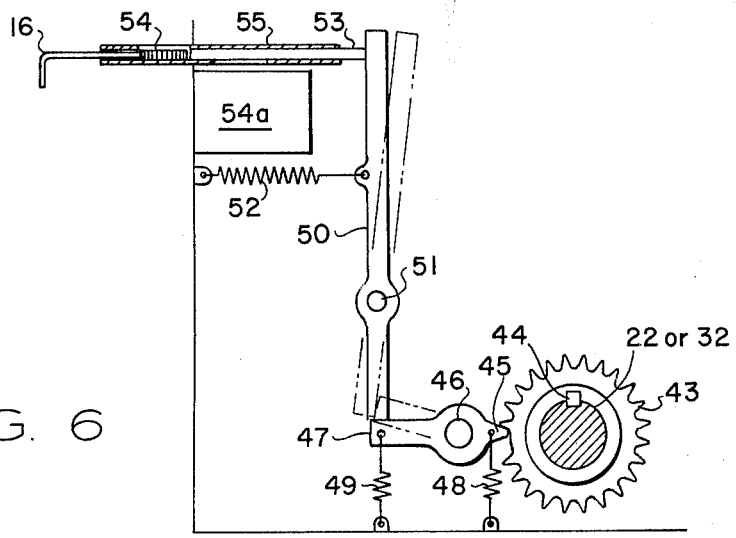
FIG. 6

TORSION TYPE ARM EXERCISING APPARATUS

BACKGROUND OF THE INVENTION

This invention relates to an exercising apparatus. In another aspect, this invention relates to an arm exercising apparatus that simulates Indian arm wrestling. In still another aspect, this invention relates to an exercising apparatus whereby a single person can exercise his arms and shoulders in a manner similar to Indiam arm wrestling.

Exercise is essential for maintaining good physical health. It is well-known that without proper exercise, muscle tissue will tend to deteriorate. Therefore, many different forms of exercise are beneficial.

One particularly useful form of exercise for exercising the arms and shoulders is an exercise known as Indian arm wrestling. This form of exercise has evolved into a rather popular sport whereby participants can obtain needed exercise and compete with other participants at the same time. When participants pit their strength against other participants in Indian arm wrestling competition, it is often difficult to fairly judge the relative strength of the participants because of various advantages that one player may take of another player in starting the wrist movement of arm movement before his opponent is fully ready. Therefore, it is highly desirable to have a mechanical device whereby uniform resisting forces can be overcome by the various participants and their true strength can be mechanically registered. Additionally, it is highly desirable to have an apparatus whereby Indian arm wrestling exercises can be carried out by only one participant.

Attempts have been made in the past to produce suitable mechanical devices for Indian arm wresting. Such prior art devices include the devices illustrated in U.S. Pat. No. 3,467,376 wherein a lever mechanism is attached to rubber bands or springs and the springs were stretched to exert an opposing force on the lever. Additional prior art devices are disclosed in U.S. Pat. No. 2,782,033 wherein a U-shaped handle is attached to parallel coil springs and the springs were stretched outwardly by exerting force on the lever. These prior art devices have many disadvantages that make them unsuitable for useful exercising and amusement devices. Such disadvantages include unnecessary bulkiness, poor control of resisting forces because of the use of stretchable helical springs and the like.

It is therefore desirable to have an inexpensive apparatus that can be conveniently utilized for Indian arm wrestling type exercise and amusement by an individual participant. It is also desirable to have an exercising apparatus for Indian arm wrestling exercise and amusement wherein the opposing force exerted on the apparatus is essentially constant and can be carefully controlled.

SUMMARY OF THE INVENTION

Accordingly, it is an object of this invention to provide a new and improved exercising apparatus. It is another object of this invention to provide a new and improved exercising apparatus that can be utilized by an individual for carrying out Indian arm wrestling type exercises. It is another object of this invention to provide a new and improved exercising apparatus for exercising the arms and shoulders of an individual wherein the amount of force being exerted by the individual on the exercising apparatus can be accurately measured. It is still a further object of this invention to provide a new and improved exercising apparatus whereby the force that the user is seeking to overcome can be uniformly maintained during the exercise program.

Other aspects, objects and advantages of this invention will be apparent to those skilled in the art from the following disclosure and appended claims.

The exercising apparatus of this invention comprises a housing with a suitable torsion means affixed to the housing. An elongated lever means extends from the housing with one end of the lever means being operably connected to the torsion means. Since the torsion means is affixed to the housing, it will resist a rotating force thereon. When force is applied to the end of the lever means extending away from the housing in a predetermined direction, the force will be transmitted to said torsion means thereby exerting a rotating force on the torsion means. Because of the operable connection between the torsion means and the lever means, a force opposing the movement of the lever means will be exerted thereon. The housing will generally have a concavity formed therein which is of such size as to permit the elbow of the user to be seated in the concavity as the user is applying force in a predetermined direction to the end of the lever means that extends away from the housing. The apparatus can also include a suitable gauge or indicating device to indicate the amount of force applied to the end of the lever means extending away from the housing. In some instances, a suitable coin actuated device may be incorporated in the housing that will restrain movement of the lever means except when the device is activated with a suitable coin.

DESCRIPTION OF DRAWINGS

Some of the preferred embodiments and features of the exercising apparatus of this invention are illustrated in the accompanying drawings wherein:

FIG. 4 is a partial side sectional view taken along line 3—3 of FIG. 2 showing a torsion bar torsion means within the housing;

FIG. 5 is a perspective view of another preferred embodiment of this invention with a portion of the housing broken away showing a gear train arrangement between the lever means and the torsion means; and FIG. 6 is a front partial sectional view taken along line 6—6 of FIG. 1 showing a coin actuated locking means to restrain rotation of the torsion means.

DESCRIPTION OF PREFERRED EMBODIMENTS

Figure 1:
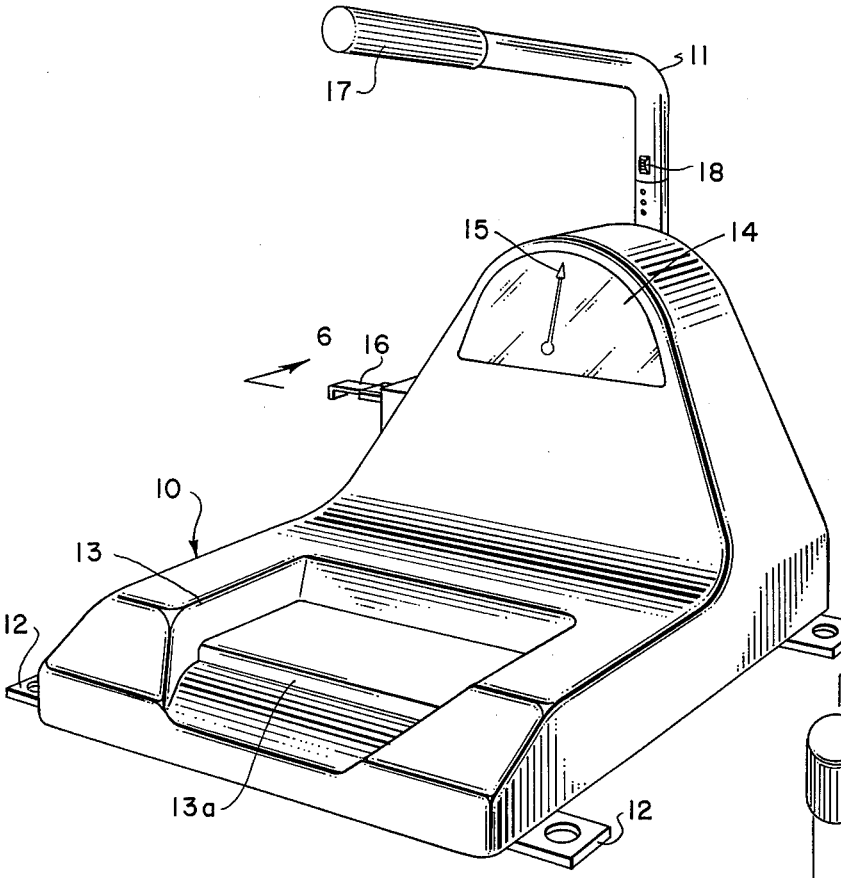
FIG. 1 is a perspective view of one of the preferred embodiments of this invention.

The preferred embodiments of this invention can be most conveniently described by referring to the drawings. The drawings illustrate several of the preferred embodiments of the invention. In the following description, the elements common to each of the exercise devices in the various drawings will be referred to by common numerical designation.

The exercise and amusement apparatus of this invention includes housing 10 and lever means 11. Housing means 10 can be constructed of any suitable material. However, it is preferred that it be of sufficiently durable material to undergo a considerable amount of strain and stress since much of the force applied to the device during use will be transmitted at least to the lower portions of the housing. Therefore, it is preferred that the housing be made of some material such as metal or a high strength plastic such as nylon and the like.

Figure 2:
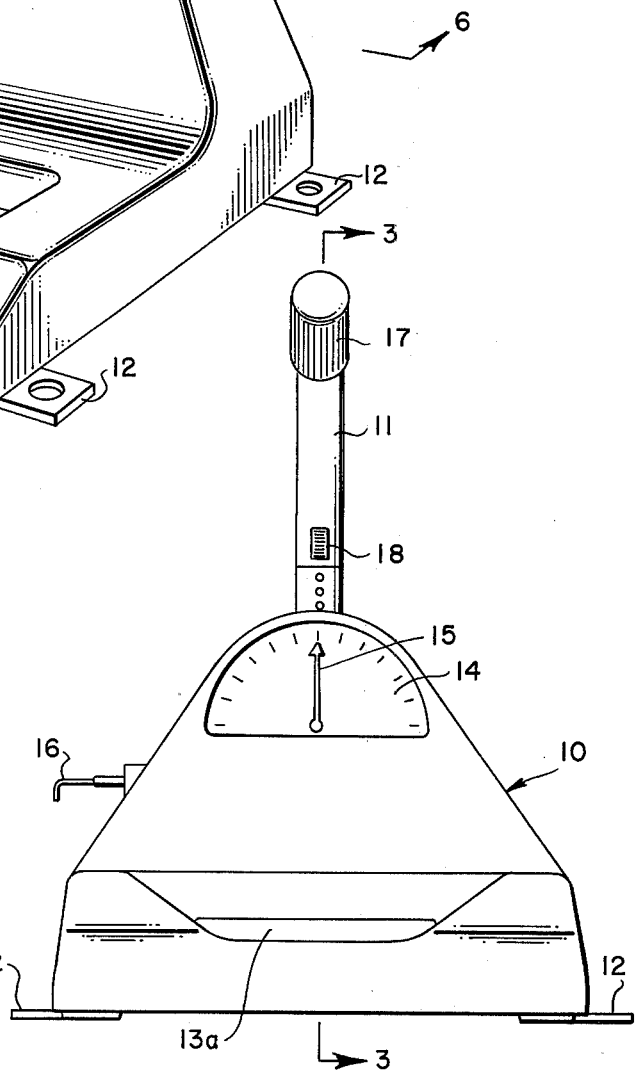
FIG. 2 is a front view of the exercising apparatus illustrated in FIG. 1.

As shown in FIG. 1, housing 10 can have suitable means such as flange means 12 for attaching the entire device to a suitable support structure such as a table top, bar top, counter top and the like. It will be noted that flange means 12 have suitable apertures therein to receive bolts or screws to securely anchor the device to the desired support structure. Preferably, housing means 10 has concavity 13 disposed within the housing that is of such size and shape to receive the elbow of the user. By utilizing a concavity with upward sloping sides, such as illustrated in FIGS. 1, 2 and 5, the elbow of the user will not slip away from the housing even when a considerable amount of force is being exerted to the lever means. If desired, cushion pad 13*a* can be disposed in the lower portion of concavity 13 to cushion the elbow of the user.

Housing 10 can also have a suitable indicator device such as a gauge or meter 14, the operation of which will be described in more detail below, to indicate the amount of force being exerted on the lever means by the user. When a gauge or meter is utilized, indicator pointer 15 can be operably connected with lever means 11 as described hereinafter. In those instances where the exercise and amusement apparatus of this invention is utilized as a coin operated device, suitable coin insertion means 16 can be affixed to housing means 10.

Although not illustrated in the drawings, housing 10 can be equipped with various removable access panels whereby portions of the housing may be removed for recovery of coins inserted into the device and for adjustment and lubrication of various components of the device held within the housing.

Lever means 11 can be made of any suitable rigid material that will undergo the strains and forces applied to the device during use. Preferably, lever means 11 will be made of a suitable high strength material such as tubular steel and the like. As illustrated in the drawings, lever means 11 extends away from housing 10 such that the free end of lever means 11 is located at a distance above concavity 13 such that the user of the apparatus may rest his elbow in concavity 13 and his hand then grips hand receiving portion 17 of lever means 11. Preferably, hand receiving means 17 is covered with a suitable non-slip material such as rubber and the like whereby the user may securely grip and hold hand receiving means 17 as the exercising device is used. In some instances, it may be desirable that hand receiving means 17 be of a ribbed or grooved structure whereby the user may securely grip the device without danger of this hand slipping away from the device because of perspiration and the like. Although not shown in the drawings, lever 11 may be covered with suitable material such as plastic and the like to simulate a human arm and hand receiving means 17 can be made to resemble a human hand. Such novelty type appearance will give more visual appeal to prospective users when the apparatus is used primarily as a coin operated amusement apparatus in bars, arcades and the like.

In one of the preferred embodiments of this invention, lever means 11 is adjustable in length whereby the distance from elbow concavity 13 to hand receiving means 17 can be adjusted in accordance with the particular length of the lower arm of the user. Several different means for adjusting the distance from elbow concavity 13 to hand receiving 17 include the use of a two section tubular member for the formation of lever means 11. As illustrated in FIGS. 1, 2, 3 and 5, the upper portion of lever means 11 slides over the lower portion of the lever means and a suitable spline or key in the upper portion of lever means 11 fits within a key way or slot in the lower portion of lever means 11 to allow the upper portion of lever means 11 to slide up and down along the lower portion of lever means 11 without the upper portion rotating around the axis of the tubular lever means. A suitable adjustment release button 18 can be incorporated into the upper portion of lever means 11 to disengage a suitable pin mechanism 18*a* that fits within apertures 18b in the lower portion of lever means 11 to limit upward or downward movement of the upper portion means 11.

The exercise apparatus of this invention utilizes a torsion means within housing 10 that is operably connected to lever means 11. The purpose of the torsion means is to exert an opposing force on lever means 11 as lever means 11 is moved in a predetermined direction by means of a force exerted on the end of lever means 11 that extends away from housing 10. One portion, i.e. one end, of the torsion means is affixed to housing 10 and another portion of the torsion means, i.e. the other end, is operably connected to lever means 11, either directly or through a suitable gear train, as will be described hereinafter.

Several different types of torsion means can be utilized in the exercise devices of this invention. Particularly useful types of torsion means are coiled torsion springs such as tapered conical torsion springs and the like. Other types of torsion means such as torsion rods or bars can also be utilized. Particularly useful types of torsion bars or torsion rods that are utilized in this invention are torsion bars and rods that are made from hard rubbery materials. These hard rubbery types of torsion bars or rods can be repeatedly twisted by the application of rotating forces on one end of the torsion means without the loss of strength.

The torsion means that are utilized in the instant invention are superior to conventional helical springs or rubber bands that may be stretched or elongated in prior art exercise devices. It has been found that the resistive force exerted by the torsion means on the lever means of the instant invention is more uniform throughout the movement of the lever means than the resistive force exerted by springs and rubber bands that are stretched and elongated in prior art exercise devices. Additionally, the torsion means used in the apparatus of this invention can be adjusted to supply more or less resistive force to movement of the lever means.

Figure 3:
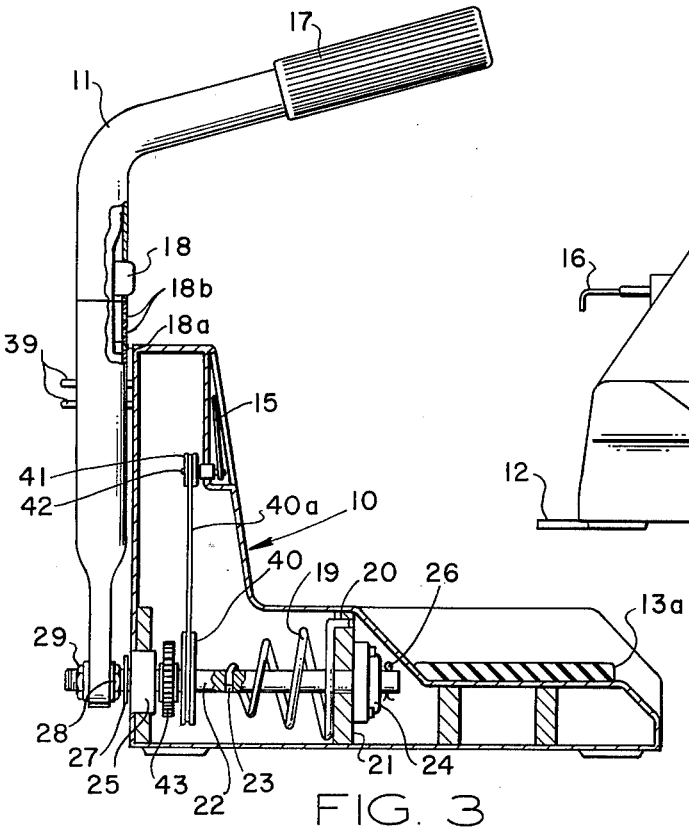
FIG. 3 is a side sectional view of the apparatus taken along line 3—3 of FIG. 2 showing a spiral spring torsion means within the housing.

Several different configurations of torsion means are illustrated in the drawings. The torsion means in FIG. 3 is coiled torsion spring 19 that can be affixed to housing 10 by means of one end of coiled torsion spring 19 being inserted into spring aperture 20 of bulkhead member 21 that is securely attached to the internal portion of housing 10. Bulkhead member 21 must be of sufficient strength to withstand the forces generated by coiled torsion spring 19 as it is subjected to forces transmitted to it by means of lever means 11.

Shaft means 22 is positioned inside coiled torsion spring 19 and the other end of coiled torsion spring 19 is inserted into shaft spring aperture 23. With the insertion of the ends of coiled torsion spring 19 into housing spring aperture 20 and shaft spring aperture 23, any rotational force applied on shaft 22 will be opposed by coiled torsion spring 19.

Shaft 22 is journaled into bearing 24 that is affixed to bulkhead member 21 and into bearing member 25 that is affixed to housing 10. Cotter pin 26 can be placed through a suitable aperture in shaft 22 to limit the movement of shaft 22 in a horizontal direction toward the left of FIG. 3. The other end of shaft 22 is threaded and washer 27 is placed over the end of shaft 22 and lock nut 28 can be screwed onto the threaded portion of the shaft to thereby limit the horizontal movement of shaft 22 in a direction toward the right of FIG. 3. Since shaft 22 is journaled into bearing members 24 and 25, shaft 22 is free to rotate within the housing with the rotation being limited by torsion spring 19. Lever means 11 has suitable apertures at the lower end thereof for slipping over the threaded end of shaft 22 and retaining nut 29 is utilized to securely affix lever means 11 to shaft 22. In some instances it may be desirable to further include a suitable lock pin or key in the lower portion of lever means 11 to key into suitable slots of taps in shaft 22 to prevent lever means 11 from rotating about shaft 22 in instances where retaining nut 29 may loosen. Using the above arrangement, it will be seen that a force exerted on hand receiving means 17 in a direction that is parallel to the plane of FIG. 2 will cause lever means 11 to pivot around the axis of shaft 22, thus causing shaft 22 to rotate within bearings 24 and 25. By virtue of the attachment of torsion spring 19 to bulkhead 21 and shaft 22, torsion spring 19 will exert an opposing force on lever means 11. As the user exerts sufficient force on hand receiving means 17 to overcome the opposing force exerted by torsion means 19, lever means 11 will continue to rotate until it is stopped by the table, counter top or bar top that supports the entire exercising device or by other suitable stops, not illustrated.

The exercising device illustrated in FIG. 4 is similar to that device described in FIG. 3 with the exception of the torsion means. Instead of using a coiled torsion spring, FIG. 4 illustrates torsion rod 30 that is utilized to supply the necessary torsion to resist movement of lever means 11. In FIG. 4, torsion rod 30 is illustrated as being a rubber torsion rod having rubber body 31 with metal connector rods 32 and 33 extending therefrom. Such rubber torsion rods are well-known in the art and can be fabricated using known techniques wherein connector rods 32 and 33 are placed in a suitable mold and rubber body 31 is vulcanized around the rods. By properly vulcanizing the rubber body around the connector rods, a torsion rod can be formed whereby opposing twisting motions on the connector rods will cause the rubber body to be twisted and such rubber body will oppose such twisting motion because of the resilient nature of the rubber.

In the apparatus shown in FIG. 4, connector rod 33 is threaded and is securely affixed to bulkhead bracket 34 by means of connector nut 35. Bulkhead bracket 34 is securely affixed to the internal walls of housing 10. By this connection, the right portion of torsion rod 30 is securely affixed to housing 10 and the righthand portion of torsion rod 30 will not rotate when a twisting force is applied to the other end of torsion rod 30. Connector rod 32 extends through and is journaled into bearing member 25 which is securely affixed to the back wall of housing 10.

By means of threads on the end of connector rod 32, lever means 11 is securely affixed to connector rods 32 with lock nut 28 and retaining nut 29 with washer 27 disposed between the lock nut and bearing 25. As in the case of the operation of the device of FIG. 3, a force exerted on hand receiving means 17, parallel to the plane of FIG. 2, will be resisted by torsion rod 30.

The apparatus illustrated in FIG. 5 differs from the apparatus of FIGS. 3 and 4 in that two separate torsion means are utilized to supply the desired torsion forces to resist movement of lever means 11. In FIG. 5, coiled torsion springs 19' can be affixed to bulkhead member 21' by inserting one end of torsion springs **19*a* into suitable apertures in bulkhead member 21' and by inserting the other end of torsion springs 19' into suitable apertures in shafts 22'. Shafts 22' can be journaled into and supported by bearings 24' and 25'. Lever means 11 is affixed to lever shaft 36 that extends through a suitable bearing means in the back wall of housing 10. Gear 37 is rigidly affixed to lever shaft 36 by suitable means such as a key and slot or a set screw so that any rotation of lever shaft 36 will cause a rotation of gear 37. Gear 37 mates with suitable gears 38 that are rigidly affixed to shafts 22' by suitable means such as keys and slots or set screws. Thus, movement of lever means 11 will cause lever shaft 36 to rotate with gear 37 rigidly affixed thereto thereby causing gears 38 on shafts 22' to also rotate. Because of the connection of torsion springs 19' to shafts 22' and housing 10, torsion means 19' will exert a force to oppose any such rotation. In one preferred embodiment, the multiple torsion springs shown in FIG. 5 will be coiled in opposite directions such that movement of hand receiving means 17 either to the right or left in FIG. 2 will cause one of springs 19' to be coiled while the other of springs 19'** will be uncoiling.

It should be noted that the foregoing discussion of the gear train has been directed to a gear train connection with two separate torsion means. It should be understood that the gear train connection between lever means 11 and the torsion means can be utilized with only a single torsion means or with more than two torsion means and that it can be utilized with torsion rods or bars as well as with torsion springs.

The torsion means should be properly sized to exert the desired resisting force against movement of hand receiving means 17. In some instances it may be advisable to place lever means stops on the back of the housing to prevent the lever means from returning past a certain point and thereafter spring load the torsion means whereby torsion force is exerted on lever means 11 even when the apparatus is not in use. Such lever arm return stops can be pins or other brackets that are affixed to the back portion of housing 10 such as return stops 39 shown in FIG. 3 that extend outwardly from the back wall of housing 10 beyond lever means 11.

In those instances where it is desirable to incorporate an indicator means to indicate the extent of movement of lever means 11 or the amount of force applied to hand receiving means 17, a suitable gauge or meter 14 can be incorporated into housing 10. Gauge or meter 14 can be graduated with any suitable graduations such as pounds of force, foot pounds of torque or any suitable novelty type graduation to indicate the relative strength or weakness of the user. Indicator pointer 15 can be operably connected to shaft 22 in FIG. 3, connector rod 32 in FIG. 4 or lever shaft 36 in FIG. 5. Thus, pulley 40 can be affixed to shaft 22, connector rod 32 or lever shaft 36 as the case may be and suitable pulley belt 40*a* may be passed around pulley 40 up over indicator pulley 41 that is attached to suitable portions of housing 10 that support indicator pulley 41. Indicator pulley shaft 42 extends through indicator pulley 41 and indicator pointer 15 is affixed to indicator pulley shaft 42. Thus, a rotation of shaft 22, connector rod 32 or lever shaft 36 will cause pulley 40 to rotate and thereby cause pulley belt 40*a* to move and turn indicator pulley 41. Rotation of indicator pulley 41 will cause indicator shaft 42 to rotate, thus causing indicator pointer 15 to move across gauge or meter 14 to indicate the relative movement of hand receiving means 17. In some instances it may be desirable to affix suitable bells or electrical contact points and the like to the indicator assembly to signal movement of hand receiving means 17 by sounding an audible signal or flashing lights etc.

The apparatus of this invention is particularly useful for exercise and amusement in locations where participants may gather for various forms of relaxation such as billiard parlors, taverns, recreation clubs and the like. In such instances, it may be desirable to equip the apparatus with a coin operated locking mechanism whereby the apparatus can be utilized only after the user inserts a suitable coin to actuate the apparatus. Such coin locking devices are well-known in the art. One suitable example of such known locking devices is illustrated in FIG. 6.

In FIG. 6, a coin operated locking device is illustrated that can be utilized with the apparatus illustrated in FIGS. 3 or 4. Locking gear 43 can be securely affixed to either shaft 22 or connector rod 32 by means of a suitable key 44 inserted into suitable slots in locking gear 43 and shaft 22 or connector rod 32. By utilizing the key arrangement, it will be noted that locking gear 43 is securely affixed to either shaft 22 or connector rod 32 and that any rotation of either the shaft or the connecting rod will also rotate locking gear 43.

Locking pawl 45 is pivotally attached to the backside of housing 10 by means of pawl pivot pin 46. Pawl lever 47 extends away from pawl pivot pin 46 on the opposite side of pawl pivot pin 46. Pawl spring 48 is attached to locking pawl 45 and the lower part of housing 10. Pawl lever positioning spring 49 is attached to pawl lever 47 and the lower part of housing 10. Pawl positioning springs 48 and pawl lever positioning spring 49 are oppositely biased and adjusted such that pawl 45 will be pulled downwardly about 15° below the horizontal plane when no external forces are exerted thereon. Pawl pivot pin 46 is positioned at approximately the same vertical height from the base of housing 10 as the axis of locking gear 43.

Actuator rod 50 is pivotally mounted on actuator rod pivot pin 51 at a position above pawl lever 47. In the locked position, as hereinafter described, actuator rod 50 will engage the upper portion of pawl lever 47 as shown by the solid lines of FIG. 6. Actuator spring 52 is attached to the upper portion of actuator rod 50 and the inner portion of housing 10. Actuator spring 52 is biased to exert a force on actuator rod 50 to move the upper portion of actuator rod toward the inner walls of housing 10 thus causing the lower portion of actuator rod 50 to move toward the axis of locking gear 43. Movement of the upper portion of actuator rod 50 is restrained by push rod 53 that is positioned horizontally inside housing 10 and held in place by suitable supporting members 55. Push rod 53 is activated and caused to move inwardly into housing 10 by means of the insertion of coin 54 that is inserted into housing 10 by means of coin insertion means 16.

In the operation of the lock mechanism, a coin is dropped into the appropriate aperture in coin insertion means 16. The coin aperture is sized to accommodate the exact change necessary to activate the device. Coin insertion means 16 is then pushed into the housing thereby causing coin 54 to engage push rod 53 and as coin insertion means 16 is pushed farther into the housing, push rod 53 will engage the upper portion of actuator rod 50 causing actuator rod 50 to overcome the resistance of actuator rod spring 52 and pivot about actuator rod pivot pin 51 and move to the right as indicated by the phantom lines appearing in FIG. 6. When coin 54 is pushed into housing 10, it will fall into coin box 54*a* which is disposed inside housing 10. By virtue of the pivoting motion caused by the action of push rod 53 on the upper portion of actuator rod 50, the lower portion of actuator rod 50 will move to the left, as indicated by the phantom lines shown in FIG. 6 thereby allowing pawl lever 47 to move slightly upward as shown by the phantom lines in FIG. 6. Pawl positioning spring 48 will supply the necessary motive force to cause pawl lever 47 to move upwardly. As pawl lever 47 moves upwardly, locking gear 43 is free to rotate in a counterclockwise direction. The counterclockwise rotation of locking gear 43 will continue while the user exerts pressure on hand receiving means 17 to cause shaft 22 to rotate in a counterclockwise direction. When pressure is released from hand receiving means 17 to allow the locking gear to rotate in a clockwise direction, by virtue of the force exerted by the torsion means on shaft 22 or connector rod 32, pawl 45 will become engaged in the teeth of locking gear 43 and pawl 45 will be pivoted about pawl pivot pin 46 such that pawl 45 will pivot upwardly and pawl lever 47 will pivot downwardly to the position indicated by the solid lines in FIG. 6. When pawl lever 47 pivots downwardly to an extent where the lower portion of actuator rod 50 will ride over the top of pawl lever 47, actuator spring 52 will exert sufficient pressure on actuator rod 50 whereby it will pivot about actuator rod pivot pin 51 to return to the position indicated by the solid lines in FIG. 6.

When the locking apparatus is in such a position as indicated by the solid lines in FIG. 6, any rotation of locking gear 43 in a counterclockwise direction will cause downward force on locking pawl 45 causing a pivoting about pawl pivot pin 46 with an attempted upward rotation of pawl lever 47 which will be resisted by the lower portion of actuator rod 50. Thus, the locking mechanism will prevent any additional counterclockwise rotation of locking gear 43 until the device is activated by the insertion of another coin. It will be understood that it is not necessary for teeth to be disposed about the entire periphery of locking gear 43 since rotation of locking gear 43 occurs only through about one quadrant when locking gear 43 is attached to shaft 22 or connector rod 32 illustrated in FIGS. 3 and 4. When pressure is released from lever means 11, locking gear will rotate in a clockwise direction. Pawl lever spring 49 will keep pawl 45 in contact with the teeth on locking gear 43, and will cause pawl lever 47 to pivot about pawl pivot pin 46 and pawl 45 will be drawn into the space between the teeth in locking gear 43. Thus, as pawl lever 47 is pivoted downwardly as shaft 22 or connector rod 32 rotate in a clockwise direction, the lower portion of actuator rod 50 will swing across the top portion of pawl lever 47 by virtue of the action of actuator spring 52. When actuator rod 50 is in position above pawl lever 47, as illustrated by the solid lines in FIG. 6, pawl lever 47 is not free to pivot upwardly and pawl 45 will thus restrain the counterclockwise rotation of locking gear 43 while gear 43 rotates to return to its original position which is firmly affixed to either shaft 22 or connector rod 32. Similar types of locking mechanisms can also be utilized with devices such as illustrated in FIG. 5.

The foregoing specification sets forth only a few of the preferred embodiments of the present invention. It is understood that various changes and modifications may be made therein without departing from the spirit and scope of the invention.

What is claimed is:

1. An arm exercising apparatus including:

a. a housing, said housing being adapted to receive the elbow of the user;

b. torsion means for resisting the pivotal movement of a force applying lever arm, said torsion means including a force applying lever arm pivotally connected to the housing, a shaft positioned within said housing and connected to the pivotal connection of the lever arm for rotation therewith, and a resilient force resistance means rigidly affixed to the housing at one end to the shaft at the other end so that either clockwise or counterclockwise pivotal movement of the lever arm will cause rotation of the shaft and twisting of the resistance means and development of a resistance in the force resistance means to a force being applied to the lever arm by a user; and c. a hand receiving means affixed to the end of said lever extending vertically away from said housing.

2. The apparatus of claim 1 wherein said torsion means is at least one spiral spring.

3. The apparatus of claim 2 wherein a concavity is formed in said housing, said concavity is of such size as to permit a elbow of a user to be seated therein.

4. The apparatus of claim 3 wherein indicator means are affixed to said housing to indicate the force exerted on said lever arm by a user.

5. The apparatus of claim 4 wherein adjustment means are incorporated in said lever arm whereby the distance from said concavity in said housing to said hand receiving means can be adjusted.

6. The apparatus of claim 4 wherein a coin actuated locking means is incorporated in said housing, said locking means being adapted to restrain rotation of said torsion means.

7. The apparatus of claim 1, further including a rotatable shaft, and wherein said spiral spring surrounds said rotatable shaft and said spiral spring is affixed to said rotatable shaft.

8. The apparatus of claim 7 wherein said lever arm is affixed to said rotatable shaft.

9. The apparatus of claim 8 further including a first gear, said first gear being operably connected to said lever means, said first gear meshing with a second gear operably connected to said rotatable shaft whereby movement of said elongated lever in a predetermined direction will cause said rotatable shaft to rotate.

10. The apparatus of claim 1 wherein said torsion means is a torsion rod.

* * * * *